US005283129A

United States Patent [19]

Renk et al.

[11] Patent Number: 5,283,129

[45] Date of Patent: Feb. 1, 1994

[54] LIGHT WEIGHT PAPER STOCK

[75] Inventors: Frederick J. Renk, Wilton, Conn.; Carolyn K. Attenborough, New City, N.Y.; Frederick C. Oettinger, East Holden; Michael S. Handzel, Ellsworth, both of Me.

[73] Assignee: Champion International Corporation, Stamford, Conn.

[21] Appl. No.: 964,384

[22] Filed: Oct. 21, 1992

[51] Int. Cl.[5] ..... B32B 29/06; B32B 29/00

[52] U.S. Cl. ..... 428/537.5; 524/47; 524/52; 524/413

[58] Field of Search ..... 524/47, 52, 413; 428/537.5

[56] References Cited

U.S. PATENT DOCUMENTS

| | | | |
|---|---|---|---|
| 3,664,912 | 5/1972 | Olson | 428/198 |
| 3,869,296 | 3/1975 | Kelly, Jr. et al. | 524/47 X |
| 3,941,912 | 3/1976 | Tajima et al. | 428/514 |
| 4,425,452 | 1/1984 | Nakata et al. | 524/47 |
| 4,656,296 | 4/1987 | Floyd | 549/379 |
| 4,659,489 | 4/1987 | Hill et al. | 428/537.5 X |
| 4,676,836 | 6/1987 | Hill et al. | 524/47 X |
| 4,776,970 | 10/1988 | Hayashi et al. | 428/537.5 X |
| 4,906,299 | 3/1990 | Dragner | 106/214 |
| 4,946,372 | 8/1990 | Avni | 428/207 X |
| 4,997,479 | 5/1991 | Hou et al. | 428/537.5 X |
| 5,003,022 | 3/1991 | Nguyen et al. | 428/511 X |
| 5,100,472 | 3/1992 | Fugitt et al. | 501/149 X |
| 5,131,951 | 7/1992 | Yoshida et al. | 525/427 X |
| 5,158,611 | 10/1992 | Ura et al. | 528/341 X |
| 5,169,715 | 12/1992 | Maubert et al. | 428/537.7 X |
| 5,177,128 | 1/1993 | Lindemann et al. | 524/44 |

*Primary Examiner*—Daniel Zirker

*Attorney, Agent, or Firm*—Evelyn M. Sommer

[57] ABSTRACT

A light weight coated paper is provided by a process wherein paper stock having a weight ranging from about 22 to 26 pounds per ream is coated with from about 4 to 8 pounds per ream of an aqueous coating formulation comprising:

a) a pigment composition comprising:
   i) from about 60 to 80 parts by weight of delaminated clay;
   ii) from about 15 to 30 parts by weight of calcined clay; and
   iii) from about 5 to 15 parts by weight of a whitening pigment;

b) from about 15 to 30 parts by weight of a starch binder;

c) from about 3 to 7 parts by weight of a starch cross-linking agent per 100 parts by weight starch;

d) from about 0.5 to 1.5 parts of a lubricant per 100 parts by weight pigment;

e) water in an amount sufficient to provide a coating formulation having from about 45 to 50% by weight solids; and f) sufficient basic buffer to raise the pH to about 8 to 8.5.

10 Claims, No Drawings

LIGHT WEIGHT PAPER STOCK

This invention relates to an improved light weight paper stock and to a coating formulation and process therefor which enables the resulting paper to be used as magazine stock. More specifically, this invention relates to a light weight paper stock which exhibits the feel, hand or "rattle" of heavier paper stock currently used as magazine stock. This paper, due to the coating formulation of the present invention, exhibits the opaqueness of heavier paper which is necessary to prevent "show-through" of the print and/or images on the reverse side of a magazine page. This paper, in printed form, is characterized by the absence of glare, easy to read text, excellent printed appearance and fine four color printed reproductions.

Due to the increase in bulk postage rates, a significant demand has recently been created for lighter paper stock suitable for magazine use. As paper stock is made lighter, however, the problem of "show-through" and a limp "feel" arise substantially precluding use of such lighter paper in magazines, brochures, annual reports, advertising pieces, direct mail and like promotional materials, especially in high quality magazines.

Accordingly, it is an object of the present invention to provide a light weight paper stock which will exhibit low glare coupled with high ink gloss and an opacity and feel or "hand" equivalent to the heavier paper stock, typically 32 to 34 pound (3300 square foot) paper stock, currently used in magazines.

It is another object of the present invention to provide a coating formulation which will enable the use of light weight paper stock in the manufacture of magazine stock exhibiting essentially the same stiffness or "rattle" as the heavier paper stock currently employed.

It is still another object of the present invention to provide a process for obtaining the light weight paper stock of the present invention.

These as well as other objects and advantages are obtained by the present invention which provides a light weight (about 30 pound) paper stock comparable in all essential respects to conventional (32–34 pound) paper stock currently in general use in the manufacture of magazines. In particular, the new light weight paper of the present invention conforms in feel, print characteristics and opacity to the heavier paper stock currently in use thereby substantially eliminating the "show through" problem which has heretofore plagued the development and use of light weight paper.

The light weight paper of the present invention is made by coating a raw paper stock obtained in conventional fashion having a weight ranging from about 22 to 26 pounds per ream with from about 4 to 8 pounds (dry basis) per ream of an aqueous coating formulation comprising:

a) a pigment composition comprising
   i) from about 60 to 80 parts by weight of delaminated clay;
   ii) from about 15 to 30 parts by weight of calcined clay; and
   iii) from about 5 to 15 parts by weight of a whitening pigment, e.g., $TiO_2$. The whitening pigment can be optionally replaced with up to about 5 parts by weight of hollow core opacifying plastic pigment per up to about 5 parts by weight of whitening pigment. The whitening pigment can also be optionally replaced by up to 5 parts by weight calcined pigment extender per up to about 5 parts by weight of whitening pigment.
b) from about 15 to 30 parts by weight of a starch binder wherein up to about 5 parts by weight of the starch binder can be optionally replaced with up to about 5 parts by weight of a polymeric latex, per 100 parts by weight of pigment;
c) from about 3 to 7 parts by weight of a starch cross-linking agent per 100 parts by weight starch;
d) from about 0.5 to 1.5 parts of a lubricant per 100 parts by weight pigment;
e) water in an amount sufficient to provide a coating formulation having from about 45–50% by weight solids; and
f) sufficient basic buffer to raise the pH to about 8 to 8.5.

The coating composition of the present invention is comprised of several components which, in combination, impart to the light weight paper stock the necessary properties enabling the resulting paper to feel and behave as if it were several pounds heavier.

The pigment composition employed in the present invention comprises from about 60 to 80 parts by weight of delaminated clay. The delaminated clay provides surface smoothness and ink holdout which are responsible for the good printing characteristics of the final product. Delaminated clay is commercially available as Alphaplate manufactured by English China Clay (ECC) America, Inc., 5775 Peachtree-Dunwoody Rd., Atlanta, Ga. 30342; Nuclay manufactured by Engelhard Corp. Menlo Park CN28, Edison, N.J. 08818; and Hydraprint manufactured by J. M. Huber Corp., Route 4 Macon, Ga. 31298.

In addition, the pigment composition comprises from about 15 to 25 parts by weight of calcined clay. The calcined clay provides bulk and optical properties to the final product. Calcined clays are commercially available such as Ansilex available from Engelhand Corp. and Alphatex available from ECC America (supra).

In addition, the pigment composition comprises from about 5 to 15 parts by weight of a whitening pigment as, for example, titanium dioxide ($TiO_2$), which imparts brightness and opacity to the final lightweight paper product. If desired, the amount of pigment can be reduced and replaced with up to about 5 parts by weight of hollow core opacifying plastic pigments per up to about 5 parts by weight of pigment. The use of these plastic microspheres assists in increasing ink gloss. These plastic microspheres are commercially available as, for example, OP-84 or HP-91 available from Rohm & Haas (Philadelphia, Pa. 19105). The pigment can also be replaced with up to about 5 parts by weight of a calcined pigment extender per up to about 5 parts by weight of pigment; however, up to about 10% more of these pigment extenders may be required. Such pigment extenders are commercially available, for example, as Norplex 604 from Nord Kaolin Company, Jeffersonville, Ga. and Engelhard HP-93 from Engelhard Corp. (supra).

The starch binder employed in the coating formulation of the present invention can be formed from pearl starch, hydroxyethylated starch, and the like. The starch binder is employed in an amount of from about 15 to 30 parts by weight of starch binder per 100 parts by weight of pigment composition. If desired, up to about 5 parts by weight of a polymeric latex can be substituted in lieu of up to about 5 parts by weight of the starch binder. Suitable polymeric latices are typically styrene butadiene rubber (SBR) latices or blends of SBR and vinyl acrylic latices such as Genflo 5084 available from GenCorp. Polymer Products, 165 So. Cleveland Avenue, Mogadore, Ohio 44260 and Dow 317, available from Dow Chemical Co., Midland, Mich. 40774. It is considered preferable to employ an all starch binder as this has been found to result in a stiffness and "rattle" which closely approaches the feel of the heavier 32 to 34 pound sheet.

The coating formulation of the present invention also includes from about 3 to 7 parts of weight of a starch cross-linking agent per 100 parts per weight of starch. Cross linking of the starch binder results in the normally hydrophilic starch becoming more hydrophobic in the dry state and therefore a more effective binder. This becomes critical in the offset printing process where the coated sheet is subjected to water in the fountain solution. If the coating on the sheet is softened (in particular the starch) by water transfer to the paper, it can cause the coating to pick off the sheet, resulting in adverse print quality, not to mention press operability problems. Cross linking of the hydroxyl groups on the starch prevents the rehydration of the starch.

Most starch cross linking agents currently employed are glyoxal based or contain some amount of glyoxal. Glyoxal has replaced the former formaldehyde-containing cross-linking agents due to the health hazards associated with formaldehyde. Most cross linking agents are generally pH sensitive with the efficiency of the cross-linking agent tending to drop off with increased pH. Other factors affecting cross-linking effectiveness include temperature and cure time. Cross-linking occurs most effectively during the drying cycle, when water is driven off by the heat of the dryer oven. The longer a sheet is allowed to cure, the better the performance of the cross-linking agent. Starch cross-linking agents are commercially available as, for example, Curesan 200 available from Pittsburgh Plate Glass, (One PPG Place, Pittsburgh, Pa. 15272); Sunrez 700M or 700C available from Sequa Chemical, One Sequa Drive, Chester, S.C. 29706-0070.

In addition, the coating composition of the present invention also contains from about 0.5 to 1.5 parts of a lubricant per 100 parts by weight pigment. Typical lubricants which can be suitably employed are calcium stearate or diglycerides. An example of a suitable diglyceride is Bercen 4569, available from Bercen, Inc. of Cranston, R.I.; calcium stearate lubricants such as Suncote 450 available from Sequa Chemical (supra), and Nopcote C-104 available from Henkel Corp., Charlotte, N.C. 28217.

The coating formulation should be applied at the highest viscosity possible to keep as much of the coating on the surface as possible. Coating viscosities in the range of 1750–3500 cps have been found suitable. Viscosity can be controlled by use of a lower viscosity starch or with enzyme control at the mill. In addition, depending upon lubricant selection, the lubricant can also be employed to build additional viscosity. If it is necessary to further increase viscosity, a suitable thickener can be added to the coating formulation such as Alcogum SL-78; L-35; L-28 from Alco Chemical Corp., Chattanooga, Tenn. 37406; and Acrysol T-1935 available from Rohm & Haas, Philadelphia, Pa. 19105.

The coating composition of the present invention is an aqueous based coating. Thus, sufficient water is added to the coating formulation to provide a solids content ranging from about 45 to 55% by weight. In addition, a suitable basic buffer such as sodium hydroxide or the like can be added to raise the pH to the range of about 8.0–8.5.

The lightweight paper stock of the present invention is prepared from a raw paper stock obtained by conventional paper-making techniques. The raw stock exhibits a weight ranging from about 22 to about 26 pounds per ream. The raw stock is made from a combination of softwood kraft and mechanical pulp, preferably 40% softwood and 60% mechanical (ground wood or thermomechanical pulp). The paper can be made on the conventional paper-making machine used for making light weight paper.

Once all of the components of the coating formulation have been admixed and homogeneously blended, the finished coating formulation of the present invention is most easily applied to both sides of the paper in a conventional manner using a suitable blade coater or other conventional apparatus. The coating speed can range from about 2000 to 4500 feet per minute and is preferably about 3000 feet per minute. After application of the coating formulation, the coated paper is passed through a drying oven maintained at a temperature ranging from about 300° to 450° F. Typically, such ovens have several different temperature controlled zones. Preferably the zones are set at about 400°/350°/350° F. The coating formulation is applied to the raw paper stock in weights ranging from about 4 to 8 pounds (dry basis) per ream.

The resulting coated paper is passed to a high speed super calendar run at a temperature ranging from about 175° to 225° F., at a pressure ranging from about 1400 to 2250 pli, and at a speed of from about 2000 to 3000 feet per minute. The coating formulation of the present invention coats and is impregnated into the raw paper stock although through viscosity control, the predominant amount of coating can be retained on the surface of the paper.

The resulting coated paper exhibits low glare, i.e., sheet gloss in the range of about 25–40% reflection. The low sheet gloss is coupled with an ink gloss of about 45–50% reflection resulting in a delta or snap gloss about equal to conventional products but providing a high quality appearance. The brightness of the resulting paper stock ranges from 68 to 72%, preferably about 70%. An opacity of at least about 88 is necessary in order to prevent "show through" which would normally be associated with a lighter weight paper. The resulting paper obtained in accordance with the present invention exhibits a L&W stiffness factor (stiffness/basis weight) ranging from 1–1.50 milli-newtons. As a consequence of the foregoing properties exhibited by the coated paper produced in accordance with the present invention, an economic substitute for the heavier 32 to 34 pound paper currently used as magazine stock is provided without the loss and feel or rattle of the heavier paper.

The following examples further illustrate the present invention. Unless otherwise stated, all percentages and parts are by weight.

EXAMPLES 1–7

In the following examples, a coating formulation comprising 70 lbs delaminated clay, 20 lbs calcined clay, 10 lbs. $TiO_2$, 25 lbs. pearl starch, 0.7 parts calcium stearate based on total solids, 3% Sunrez 700 C. (on total dry starch) was prepared and admixed with sufficient water to provide a composition having 45% solids and a viscosity of 3000 cps. NaOH was added to raise the pH to 8.5.

Raw paper stock (40% softwood/60% ground wood) having a basis weight of about 24 pounds per ream was coated on both sides with about 5 pounds per ream of the coating formulation at a coating speed of 3000 ft/min. The resulting coated paper was dried upon passage through a drying oven in which three separate heating zones were maintained at (400°/350°/350° F.) and then was passed to a super calendar running at 200° F., at a pressure of 2000 pli and a speed of 2500 ft/min., and then passed to windup.

The results of Examples 1 through 7 as well as the typical properties for 32 pounds/ream paper (control) are reported in Table I. As can be seen, the 30 pound/ream paper obtained in accordance with the present invention compares quite favorably with the heavier 32 pound/ream stock currently used for high quality magazine paper stock.

TABLE I

| Example | Coated Paper Basis Weight (#/ream) | Caliper[1] (mils) | Opacity[2] | Sheet Gloss[3] (% Reflection) | Brightness[4] (%) | Paper Smoothness[5] (microns) | Ink Gloss[3] (% Reflection) | L & W Stiffness Factor[6] | Printing Press Ink Gloss[3] | Surface Strength[7] |
|---|---|---|---|---|---|---|---|---|---|---|
| Control | 32 | 1.96 | 88.6 | 39.6 | 70.7 | 1.44 | 56.5 | 1.25 | 54.7 | 32 |
| 1 | 30.0 | 1.96 | 88.3 | 27.3 | 70.9 | 1.76 | 49.7 | 1.41 | 42.3 | 35.4 |
| 2 | 30.0 | 1.91 | 88.0 | 30.5 | 70.9 | 1.60 | 45.7 | 1.33 | 37.7 | 35.4 |
| 3 | 30.2 | 1.83 | 88.1 | 25.1 | 70.8 | 1.73 | 45.6 | 1.46 | 38.9 | 35.8 |
| 4 | 30.2 | 1.88 | 88.5 | 29.6 | 71.2 | 1.57 | 47.6 | 1.33 | 37.5 | 37.1 |
| 5 | 30.0 | 1.87 | 88.2 | 28.3 | 70.9 | 1.62 | 47.0 | 1.39 | 38.2 | 30.3 |
| 6 | 29.8 | 1.90 | 89 | 27 | 71.6 | 1.69 | 46.3 | 1.40 | 38.5 | 40.5 |
| 7 | 30.3 | 1.86 | 89.2 | 33.4 | 71.6 | 1.53 | 49.8 | 1.27 | 42.8 | 35.3 |

TAPPI Test Methods
[1]T411
[2]T425 (see also, ASTM 589)
[3]T480
[4]T454
[5]Parker Print Surface conditions - pressure 10 KGF/cm$^2$ with soft backing

[6]L & W Stiffness Factor = $\frac{\text{Geometric mean (GM)}}{\text{basis weight (BW)}}$ Geometric mean = $\sqrt{MD \times CD}$ See, ISO #2493 sample dimensions 1½" × 1½" testing length 5 mm
[7]Units expressed as Kilopoise/cm/sec.

What is claimed is:

1. A light weight coated paper comprising paper stock having a weight ranging from about 22 to 26 pounds per ream having a coating thereon of the dried residue of from about 4 to 8 pounds per ream of the dried residue from an aqueous coating formulation comprising:

a) a pigment composition comprising:
   i) from about 60 to 80 parts by weight of delaminated clay;
   ii) from about 15 to 30 parts by weight of calcined clay; and
   iii) from about 5 to 15 parts by weight of a whitening pigment;
b) from about 15 to 30 parts by weight of a starch binder;
c) from about 3 to 7 parts by weight of a starch cross-linking agent per 100 parts by weight starch;
d) from about 0.5 to 1.5 parts of a lubricant per 100 parts by weight pigment;
e) water in an amount sufficient to provide a coating formulation having from about 45 to 50% by weight solids; and
f) sufficient basic buffer to raise the pH to about 8 to 8.5 said coated paper exhibiting a sheet gloss in the range of about 25 to 40% reflection; an ink gloss of about 45 to 50% reflection; a brightness of from about 68 to 72%; an opacity of at least about 88; and a L&W stiffness factor ranging from about 1 to 1.50 milli-newtons.

2. A light weight coated paper as defined in claim 1 wherein up to about 5 parts by weight of the whitening pigment is replaced with up to about 5 parts by weight of hollow core opacifying plastic pigment.

3. A light weight coated paper as defined in claim 1 wherein up to about 5 parts by weight of the whitening pigment is replaced with up to about 5 parts by weight of a calcined pigment extender.

4. A light weight coated paper as defined in claim 1 wherein the whitening pigment is $TiO_2$.

5. A light weight coated paper as defined in claim 1 wherein up to about 5 parts by weight of the starch binder is replaced with up to about 5 parts by weight of a polymeric latex.

6. The light weight coated paper as defined in claim 1 wherein the starch binder is comprised of pearl starch.

7. The light weight coated paper as defined in claim 1 wherein the starch binder is comprised of hydroxyethylated starch.

8. A light weight coated paper as defined in claim 5 wherein the starch binder contains up to about 5 parts by weight of a styrene butadiene rubber latex.

9. A light weight coated paper as defined in claim 5 wherein the starch binder contains up to 5 parts by weight of a blend of styrene butadiene rubber and vinyl acrylic latices.

10. The light weight coated paper of claim 1 wherein the lubricant is calcium stearate.

* * * * *